United States Patent [19]

Rousseau

[11] Patent Number: 5,040,438

[45] Date of Patent: Aug. 20, 1991

[54] POWERED WRENCH APPARATUS

[75] Inventor: Joseph E. R. Rousseau, St. Mathieu, Canada

[73] Assignee: Longyear Company, Salt Lake City, Utah

[21] Appl. No.: 502,058

[22] Filed: Mar. 30, 1990

[51] Int. Cl.[5] ..... B25B 13/50

[52] U.S. Cl. ..... 81/57.35; 81/57.16; 81/57.24

[58] Field of Search ..... 81/57.16, 57.24, 57.34, 81/57.35, 57.4; 173/46, 164, 147; 175/52, 85

[56] References Cited

U.S. PATENT DOCUMENTS

| | | | |
|---|---|---|---|
| 3,985,189 | 10/1976 | Jahnke et al. | 173/164 X |
| 3,994,350 | 11/1976 | Smith et al. | 173/147 X |
| 4,475,604 | 10/1984 | Albertson et al. | 173/46 X |
| 4,632,618 | 12/1986 | Issakainen | 175/52 X |
| 4,721,171 | 1/1988 | Leppänen | 81/57.16 X |

*Primary Examiner*—James G. Smith
*Attorney, Agent, or Firm*—Clayton R. Johnson

[57] ABSTRACT

Power wrench apparatus for holding a drill rod stationary as a rod joint is being broken that includes a first piston cylinder combination for pivotally moving a mounting bracket relative to a frame between wrench rod clamping and releasing positions, a second piston cylinder and an arm member pivotally mounted on the mounting bracket, and a slide handle and a jaw actuator pivoted to the slide member and second piston cylinder respectively to act through a jaw bracket and the slide member to relatively move the wrench first and second jaws from their rod release to their rod clamping position when the mounting bracket is in its wrench clamping position when the piston rod of the second piston cylinder is extended. The wrench includes a nut for manually adjusting the second jaw relative to the first jaw while there is provided stop devices and a spring for limiting longitudinal movement of the slide member relative to the arm member and resiliently urging the slide member to move the first jaw towards its rod release position.

21 Claims, 5 Drawing Sheets

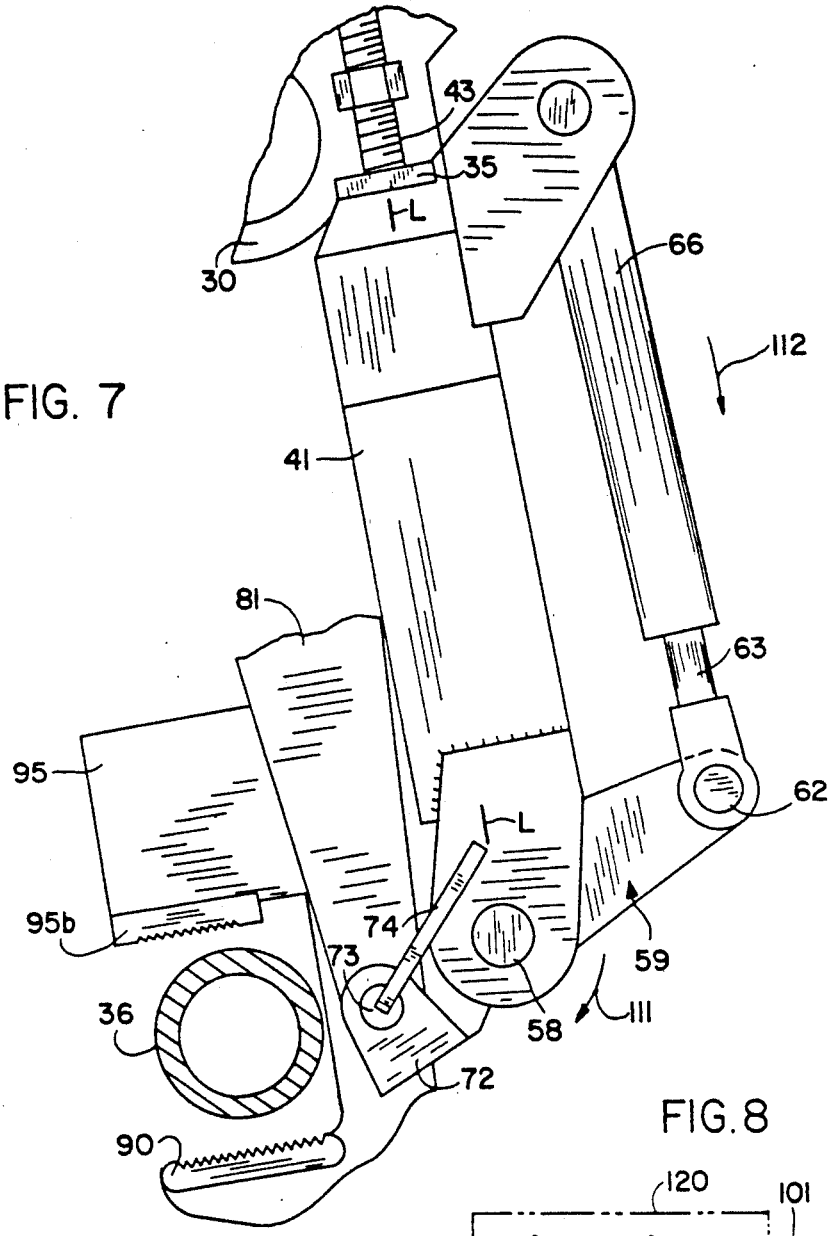
FIG. 7
FIG. 8
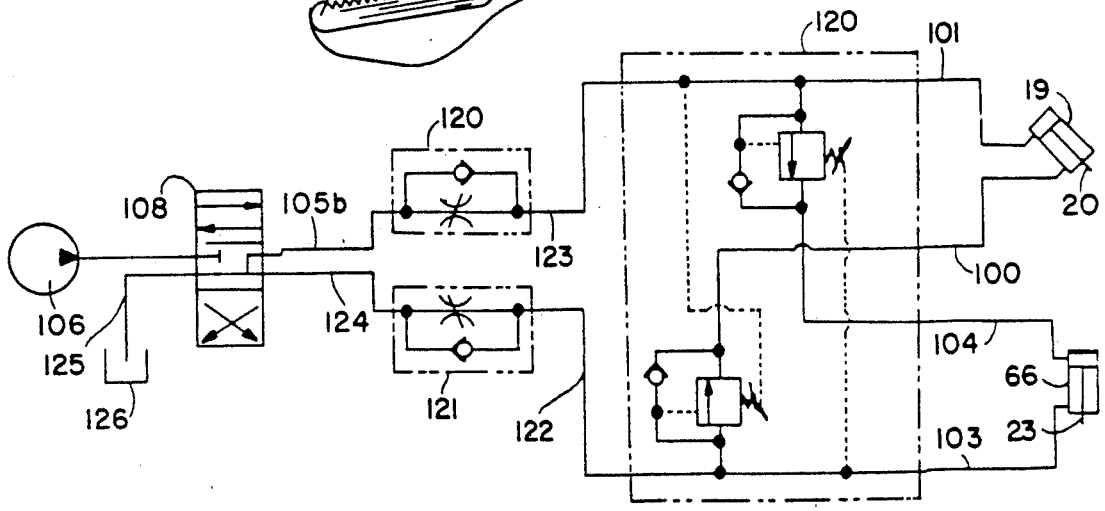

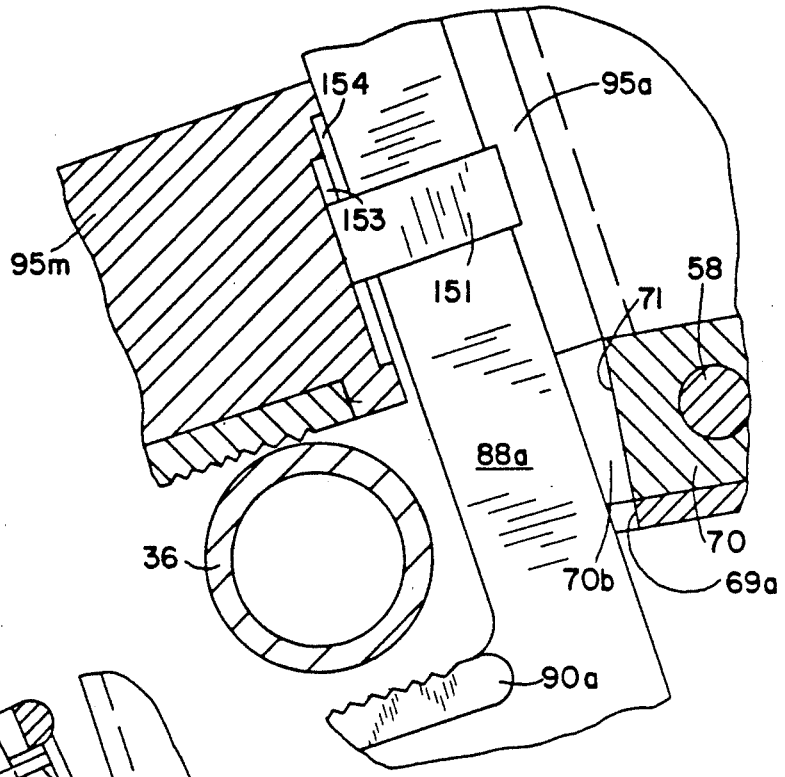
FIG. 10
FIG. 9
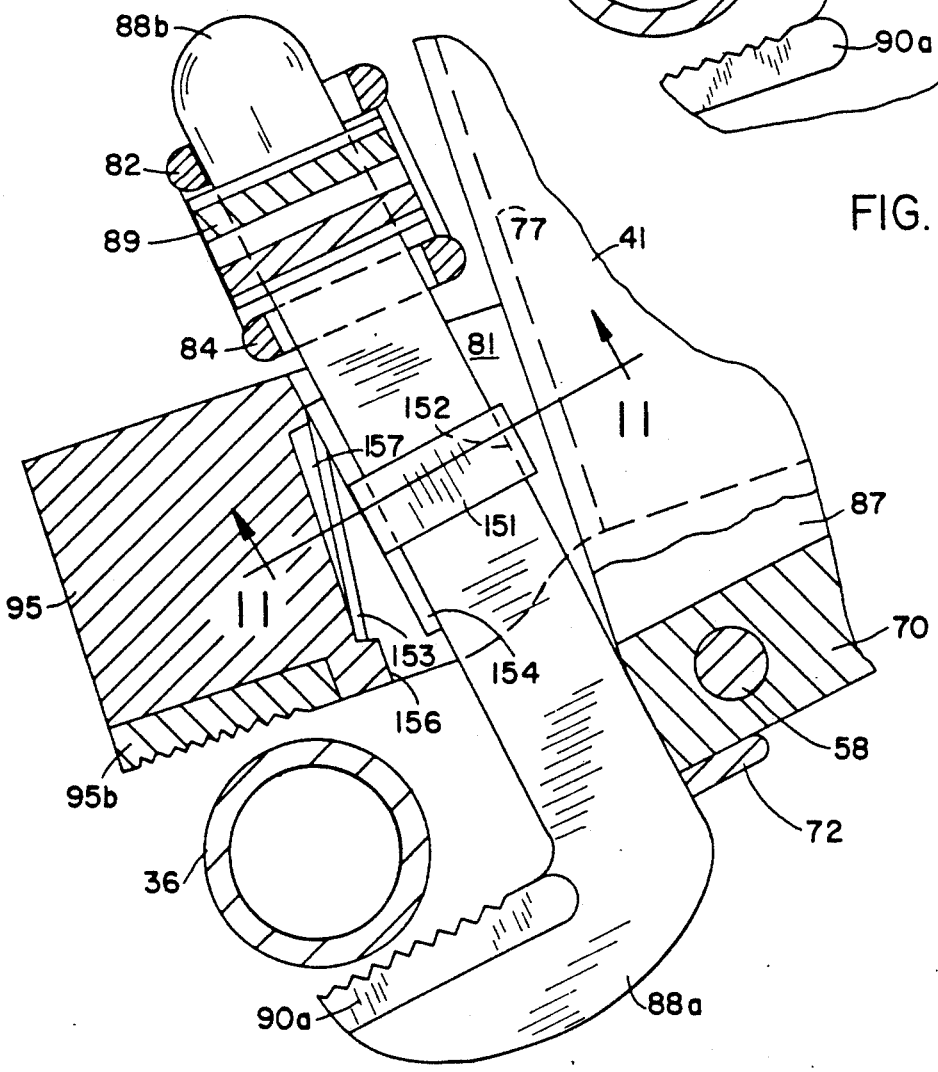

POWERED WRENCH APPARATUS

BACKGROUND OF THE INVENTION

The present invention relates that to a wrench mountable on a frame for movement under power between an out of the way datum position to a position adjacent to a pipe or drill rod and thereafter move at least one wrench jaw from an unclamped rod position to a rod clamping position.

In U.S. Pat. No. 3,994,350 to Smith et al there is disclosed a drill rig frame on which one end of a hydraulic cylinder is pivotally mounted and its piston rod pivotally connected to a shaft to pivot the shaft and thereby a wrench between a position aligned with a bore hole and a position out of the aligned position, and a second cylinder pivotally mounted on the wrench arm and pivotally connected to wrench jaw for moving the jaw from a rod clamped to a rod unclamped position (see FIGS. 9 and 10 of the patent).

Each of U.S. Pat. Nos. 4,475,604 to Albertson; 4,345,439 to Rassieur and 3,985,189 to Jahnke disclose a pipe wrench having its fixed jaw member one end pivotally connected to a piston cylinder combination for being moved thereby and an adjustable jaw mounted on the fixed jaw for being adjustable relative to the fixed jaw by rotating the wrench nut.

U.S. Pat. No. 4,721,171 to Leppanen discloses a first piston cylinder combination for moving one jaw relative to another between rod clamping and unclamping positions and a second piston cylinder combination for moving the jaw mount between two spaced positions, one of which is aligned with the rod.

The present apparatus is directed to making improvements in wrench apparatus such as disclosed in the above mentioned patents and to overcome dangerous conditions associated with the use of manually held and/or moved wrenches used during rod joint breaking operations.

SUMMARY OF THE INVENTION

A drill rig frame pivotally mounts one end of a piston cylinder combination while the opposite end is pivotally connected to a wrench mounting arm for pivoting the arm between a datum position and position the wrench is aligned with a drill rod aligned with a bore hole. The arm is pivotally relative to the rig frame and mounts a wrench housing for movement therewith and limited translator movement relative thereto. The housing mounts a first wrench jaw in fixed relationship thereto and pivotally mounts the mid-portion of a rocker arm. A second piston cylinder combination at one end is pivotally connected to one end of the housing and at the opposite end is pivotally connected to one end of the rocker arm. The opposite end of the rocker arm is pivotally connected to one end of a jaw bracket while the jaw bracket also in part mounts a wrench hooked jaw and has the wrench fixed jaw extended therethrough. The first piston cylinder combination is operable for moving the arm between a position that the wrench jaws are in a datum position remote from a drill rod and a position for clampingly engaging the rod while the second piston cylinder combination is provided for operating through the rocker and housing to move the jaws between a rod unclamped position and a rod clamping position.

One of the objects of this invention is to provide new and novel means for moving wrench jaws between jaw release and jaw clamping positions. Another object of this invention is to provide new and novel power operated means for moving jaws that are manually adjustable relative to one another between drill rod release and clamping positions. Still another object of this invention is to provide new and novel means for mounting pipe wrench type tool between an out of the way position and a rod clamping position and the tool jaws to a rod clamping position.

BRIEF DESCRIPTION OF THE DRAWINGS

FIG. 7 is a plan view of a portion of the structure of FIG. 2 other than the rocker, slide member, arm member and wrench jaws are in their rod release position;

FIG. 8 is a schematic showing of hydraulic circuitry:

FIG. 9 is a fragmentary view of the wrench, the slide housing and adjacent structure showing the wrench in a rod release position with part of the upper part of the hook jaw actuator and slide housing not being shown and part of the fixed jaw and jaw actuator being shown in cross section;

FIG. 10 is partial view corresponding to FIG. 9 showing the wrench in its rod clamping position.

Referring to FIG. 1 there is shown a fragmentary portion of a drill rig frame (support frame) 10 having a mounting frame 11 secured thereto. One end of a two way piston cylinder combination 19, 20 is connected to the mounting frame through a pivot 13 while the piston rod 20 is pivotally connected at 17 to tabs 15 of a wrench mounting bracket, generally designated 12. The pivot 13 is mounted by the bracket 16 which in turn is attached to mounting frame 11 by bolts (not shown) extended through elongated slots (not shown) in frame for selected adjusted positions in one of the directions of the double headed arrow 18.

Figures 1, 3:
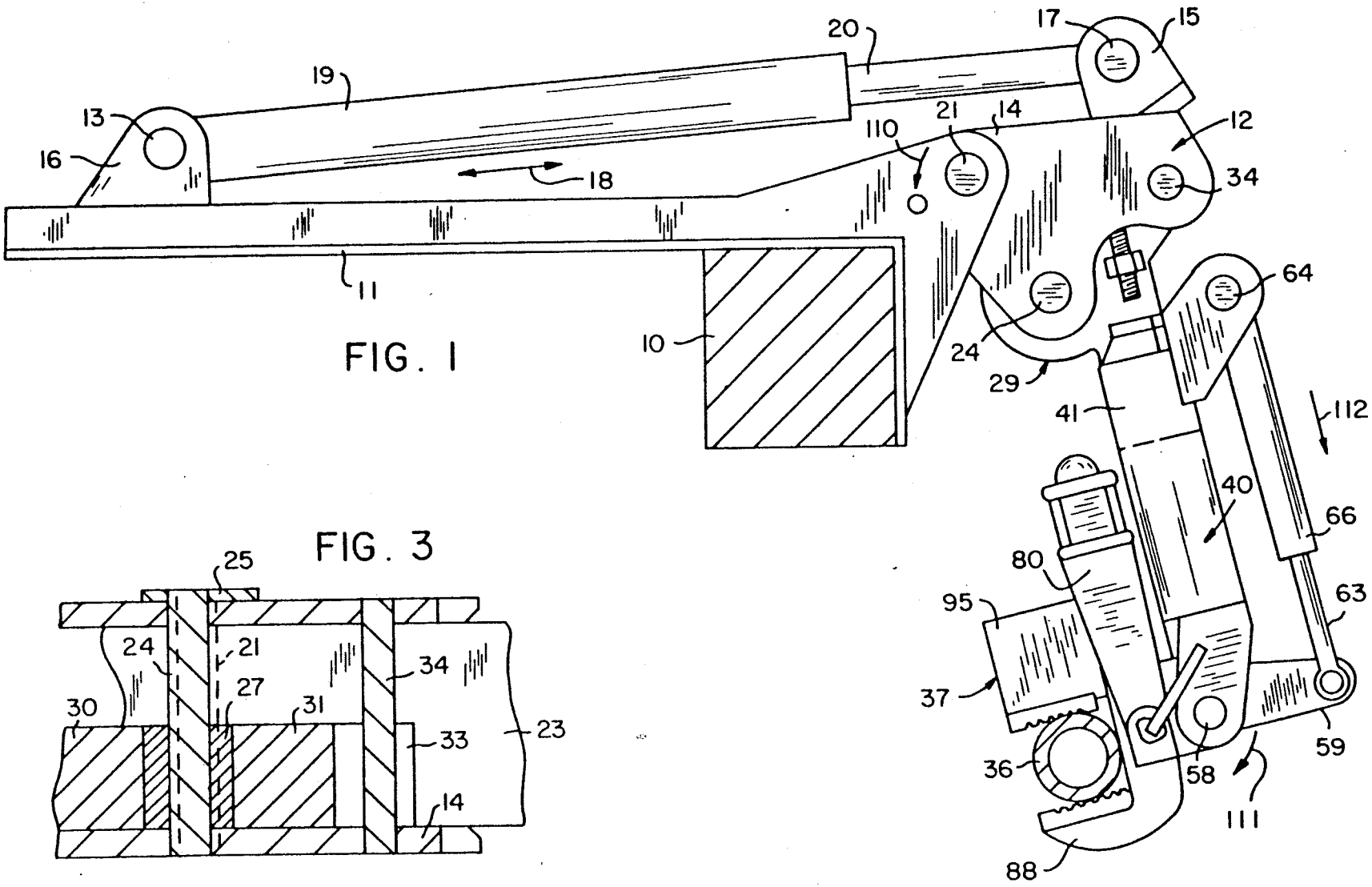
FIG. 1 is a plan view of the powered wrench in a rod clamping position.
FIG. 3 is a cross section view of the wrench bracket that is generally taken along the lines and in the direction of the arrows 3—3 of FIG. 2.
Figure 4:
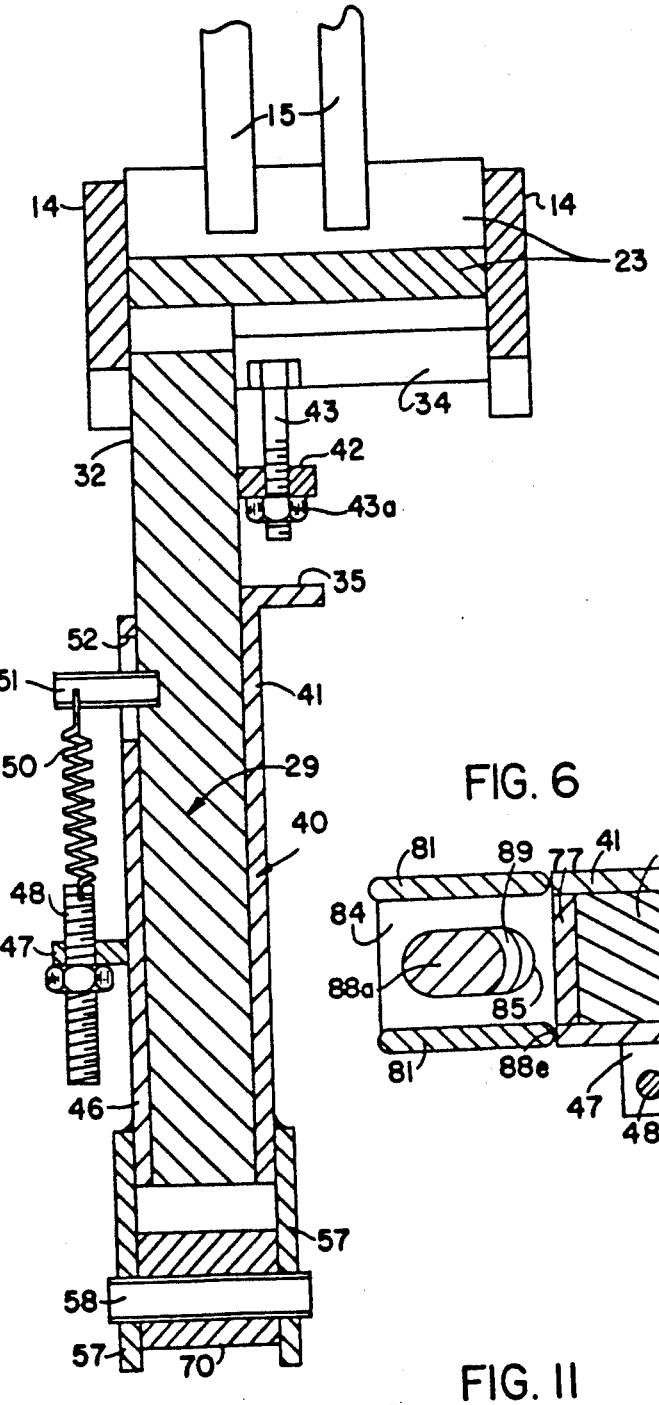
FIG. 4 is a longitudinal cross section view of the wrench mounting bracket, slide mounting member, the rocker and arm member that is generally taken along the line and in the direction of the arrows 4—4 of FIG. 2.

The wrench mounting bracket 12 includes top and bottom plates 14 that at their one corner portions are pivoted to the mounting frame 11 by a removable pivot 21 while a bracket web 23 extends between plates 14 and mounts tabs 15 (see FIGS. 3 and 4). A pivot member 24 is removably extended through second corner portion of the plates 14 and is retained in place by being attached to a member 25 which in turn is attached to the top plate by a cap screw 26. Similarly, members 25, 26 removably mount the pivot 21.

A juncture portion 30 of a wrench mounting arm member, generally designated 29, is in part located between plates 14 and is mounted by a slide member 27 that in turn is mounted for vertical slidable movement by pin 24. As may be in part seen from FIGS. 3 and 4, the vertical spacing of the plates 14 is sufficiently greater than the thickness of the arm member 29 to permit the arm member moving vertically the distance for unthreading (breaking) a rod joint while the drill rod 36 is gripped by the wrench, generally designated 37, to block rotation of rod 36 in one angular direction, but permit the vertical movement of the rod sufficiently to break the rod joint while the rod 36 is in alignment with the bore hole (not shown). The arm member also has a short arm (leg) 31 joined to juncture portion 30 to extend radially away from the arm pivot 24 and has a radially outwardly opening notch 33 to have a pin 34 extended therethrough to prevent rotation of the arm member independent of mounting bracket 12. The pin is mounted by the plates 14 to pivot therewith. The notch 33 facilitates the replacement of the arm member.

The arm member 29 also has a longitudinally elongated long arm (leg) 32 joined to the juncture portion 30 to extend away therefrom and the mounting bracket at an obtuse angle relative to the short leg. The long arm is generally rectangular in transverse cross section. A longitudinally elongated slide handle, generally designated 40, is mounted on the arm member long leg for limited longitudinal movement relative thereto. The slide handle includes a generally rectangular, longitudinally elongated slide housing with the long leg therein to extend a major part of the length of the slide housing, the slide housing including a top plate 41 with an upright flange 35 that is at its end which is adjacent to the mounting bracket 12. A stop tab 42 is mounted on the long arm 32 intermediate the flange 35 and the bracket web 23, the tab in turn threadingly mounting an adjustment stop bolt 43 for longitudinal adjustably varying the minimum spacing of the slide handle from the bracket web 23, i.e. one limit position of the wrench relative to the bracket web 23 during use. A lock nut **43*a* is threaded on the bolt to but against tab 42**.

The handle housing also has a bottom wall 46 with a return tab 47 mounted on an intermediate portion thereof to extend therebeneath, a threaded return stud 48 being mounted by the tab for longitudinal adjustable movement. The stud has one end of a return spring 50 attached thereto while the spring opposite end is attached to a pin 51 that is dependingly mounted by the long arm 32 to extend through the longitudinally elongated opening 52 in the bottom wall 46. The return spring resiliently urges the slide handle to move in a direction to retain the flange 35 in abutting relationship to the adjacent end of the stop bolt 43. The slide housing has side walls 77 transversely spaced and of lengths relative to the arm 32 to block any significant transverse or pivotal movement of the slide housing relative to the long arm 32 while permitting longitudinal movement of the slide housing relative to the long arm.

The slide handle also includes ears 57 joined to the slide housing top and bottom walls to extend away therefrom in a direction away from flange 35, the ears removably mounting a rocker pivot 58 to extend through an intermediate portion of a transversely extending rocker (hook jaw actuator), generally designated 59. One transverse end portion of the rocker is pivotally connected at 62 to the clevis end of piston rod 63 of a two way piston cylinder combination that has a cylinder 66 pivotally connected by a pivot 64 to the slide handle ears 65. The ears 65 are joined to the slide housing longitudinally remote from the ears 57.

The rocker 59 includes the transversely elongated rocker arm 70 that at its end portion opposite pivot 62 has a vertical intermediate transversely outwardly opening wrench jaw notch 71 and a vertical plate 69 joined thereto and having a transversely opening notch **69*a* that opens longitudinally to notch 71. Longitudinally extending ears 72 are joined to the vertical plate vertically above and below the arm 70 in vertical spaced relationship thereto. Upper and lower pivot pins 73 are removably extended through apertures in the top and bottom pair ears 72, rocker arm portion 70*b* that in part defines notch 71 and the end portions of plate arms 81 respectively of a hook jaw bracket, generally designated 80, plate arm plate end portions extending into the top and bottom notches 71*a* defined by the plate 69, arm portion 70*b* and the respective pair of ears 72. Top and bottom flanges 74 are welded to the ears 57 to extend closely adjacent to the pivots 73 to retain the pivots in place on the rocker while permitting the rocker to pivot about pivot 58 and relative to the ears 57, the pivots 73 having enlarged diameter head portions vertically between the adjacent ear 72 and flange 74**.

Figure 2:
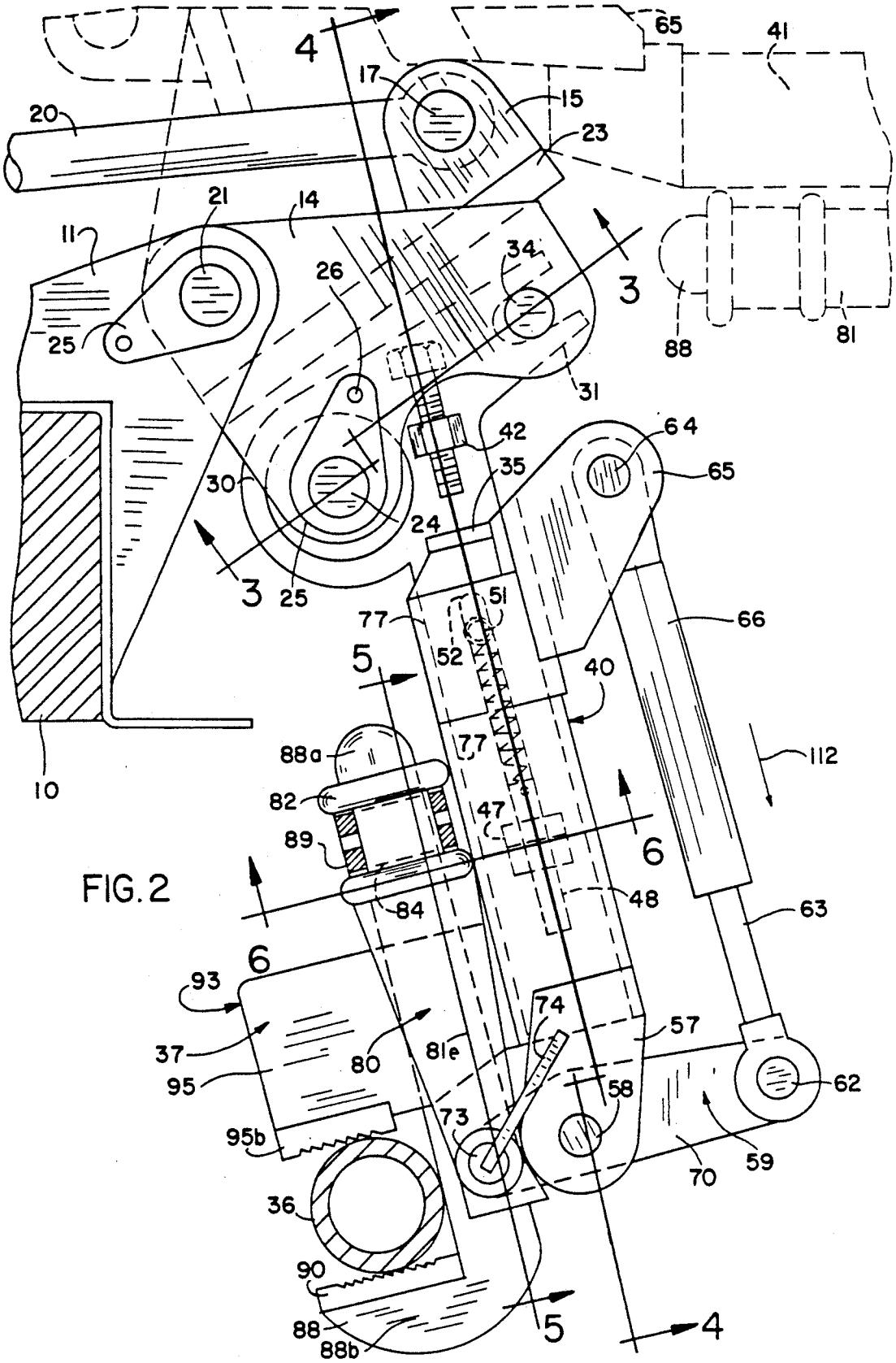
FIG. 2 is an enlarged plan view of the wrench of FIG. 1, the wrench in the position of FIG. 1 being shown in solid lines and the wrench is shown in an out of the way datum position in dotted lines.
Figure 5:
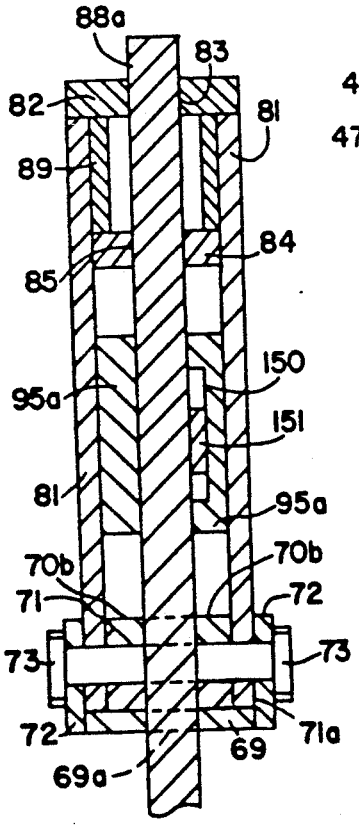
FIG. 5 is a longitudinal cross sectional view of the rocker, the hook jaw bracket and the wrench jaws that is generally taken along the line and the direction of the arrows 5—5 of FIG. 2.
Figure 6:
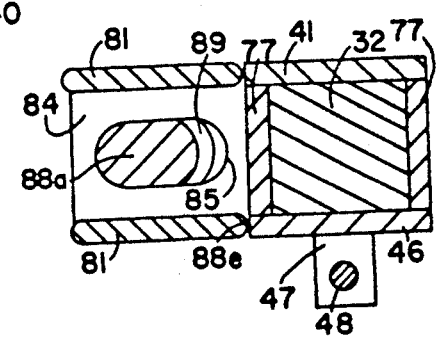
FIG. 6 is a transverse cross sectional view Of the arm member, hook jaw bracket, slide housing member and the hook jaw that is generally taken along the line and in the direction of the arrows 6—6 of FIG. 2.

The wrench 37 includes the hook jaw bracket 80 which in turn has the longitudinally elongated, vertically spaced, top and bottom plate arms 81 (see FIGS. 2, 5 and 6). The one end portions of the arms 81 are pivotally mounted by the pivots 73. An end plate 82 is joined to the ends of the arms 81 remote from the pivot 73 while an intermediate plate 84 are joined to the arms more closely adjacent to plate 82 than the pivots 73. The plates 82, 84 extend transversely outwardly of each adjacent side edge portion of the plates 81 that extend longitudinally therebetween and have central transversely elongated openings 83, 85 respectively. The elongated leg **88*a* of the wrench hook jaw 88 is movably extended through the openings 83, 85, the transverse dimensions of the openings 83, 85 being such to permit limited rocking motion of hook jaw relative to the jaw bracket. A conventional wrench nut 89 is threadedly mounted on the hook jaw long leg between the plates 81, 82 and 84 to extend transversely outwardly of the legs 81 to permit the nut being manually rotated for adjusting the longitudinal position of the hook jaw relative to the hook jaw bracket (the threads on the hook jaw not being shown). The spacing of the plates 82, 84 is sufficient to permit the above mentioned rocking movement but at the same time only permit limited longitudinal movement of the hook jaw relative to the jaw bracket other than when the nut is being rotated relative to the hook jaw. The short leg 88*b* of the hook jaw which extends at generally right angles to the jaw long leg is joined to a jaw insert 90. The pivotal movement of the jaw bracket about pivot 73 in one angular direction is limited by at least one of the plates 82, 84 abutting against the slide housing and in the opposite direction by the wrench abutting against the vertical edge of plate 69 that in part defines the transversely opening notches 69*a*, 71 through which the hook jaw long leg 88*a*** extends.

Figure 11:
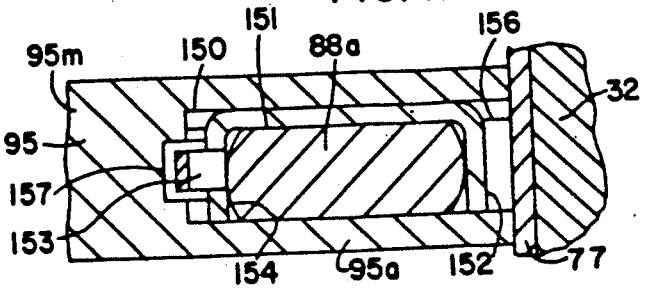
FIG. 11 is a fragmentary cross sectional view generally taken along the line and in the direction of the arrows 11—11 of the FIG. 10.

The wrench also includes a fixed jaw 93 that is fixedly joined to the longitudinally intermediate portion of the side wall 77 of the slide handle housing to extend transversely away from the slide housing opposite the piston cylinder combination 66, 63 and in the same direction that the hook jaw short leg 88*b* extends away from the hook jaw long leg. The fixed jaw includes a fixed jaw bracket 95 that has a channel 156 opening to the adjacent slide housing wall 77 and the hook jaw long leg extending therethrough (see FIGS. 9–11). The channel 156 is of a size and shape to permit movement of the hook jaw relative to the fixed jaw (heel jaw) as set forth herein and is in part defined by vertically spaced jaw bracket top and bottom legs 95*a* and the jaw bracket main body portion 95*m* with the hook jaw extending between the legs 95. Further the bracket legs 95*a* are welded to the slide housing and are longitudinally between the plate 84 and the rocker arm 70 in longitudinal spaced relationship to members 70, 84.

A jaw spring is provided to act between the bracket 95 and the hook jaw to constantly urge the hook jaw toward its rod release position, the jaw spring including a spring web 151 extending through a downwardly opening transverse groove 150 in the upper leg 95*a* of bracket 95. The jaw spring also includes a vertical leg 152 joined to the web 151 that is located between the long leg and the slide housing, and a main body 154 joined to the web opposite leg 152, members 151, 153, 154 forming a resilient clipping fit to the hook jaw long leg with the spring legs abutting against opposite longitudinally extending surfaces of the hook jaw long leg while permitting longitudinal movement to the hook jaw long legs. The long leg, including its threaded portion, is longitudinally movable relative to the jaw springs, the threads on the transverse opposite edges of the long leg not being shown. Additionally the relative dimensions of the groove 150 and the spring web are sufficient to permit the movement of the hook jaw relative to fixed jaw such as described herein, but still retain the jaw spring in the channel 156.

The jaw bracket 95 has a cutout 157 that opens to the channel 156 for having the jaw spring finger 153 extended thereinto for constantly resiliently urging the main body 154 of the jaw spring toward the slide housing but permit the hooked jaw moving relative to the fixed jaw between its positions.

As may be seen from FIG. 2, the plates 82, 84 are of greater transverse widths than the portion of the plate arms 81 that are adjacent to the pivot 73 whereby the plate arms may be pivoted a limited amount relative to the slide housing at the location that the vertical rounded surface of plate 84 when and plate 82 is spaced from the adjacent slide housing side plate 77 and the plate 84 abuts against the housing. One or both of the vertical rounded edges of both plates 82, 84 may abut against the slide housing wall 77 as the housing and the jaw bracket longitudinally move relative one another.

When a rod is clampingly gripped by the jaws, desirably the pivot axes of the 62, 73 and 58 are at least substantially located and preferable located in a vertical plane that extends nearly perpendicular and preferably extends perpendicular to the horizontal and to the vertical plane of the line L—L of the housing housing (line L—L shown in FIG. 7), the piston rod of the piston cylinder combination 63, 66 is extended, and the slide handle flange is longitudinally spaced from the stop bolt 43. The preceding sentence assumes the drilling direction is a vertical direction. When the jaws are out of engagement with the drill rod and the piston rod 63 is in its retracted position, the return spring resiliently retains the flange 35 in abutting relationship to the stop bolt. The slot 52 is of a sufficient length to permit the pin 51 moving between positions the housing flange abuts against the stop bolt and the slide housing moving such the jaws clampingly engage the drill rod within the desired range of longitudinal adjusted positions of the stop bolt and the hook jaw relative to the slide handle.

In order to control the operation of the piston cylinder combinations there is provide hydraulic components and circuitry that includes fluid lines 100 and 101 connected to opposite end portions of the cylinder 19 and to ports of a conventional dual sequence valve 102 that functions as will be set forth. The circuitry also includes fluid lines 103 and 104 fluidly connected to opposite end portions of the cylinder 66 and to ports of the sequence valve. The sequence valve also has a port that is fluidly connected through a line 123 to a flow control (throttle) valve 120 which in turn is connected through line 105*b* to a port of a directional control valve 108. A line 105*a* connects another port of the valve 108 to a source of pressurized fluid (pump) 106. A third port of valve 108 is connected through line 125 reservoir while a fourth port is connected through line 124 to a flow control (throttle) valve 121. Valve 121 is connected through line 122 to a sixth port of the sequence valve. Valve 108 controlls the flow of pressurized fluid from the source 106 to the sequence valve as may be seen from FIG. 8. Valves 120, 121 are provided to control the rate of movement of the respective piston rod resulting from the application of fluid under pressure to the corresponding cylinder.

When it is desired to pivot the wrench 37 from its datum dotted line position to its solid line position of FIG. 2 valve 108 is opened to apply pressurized fluid to the sequence valve which initially applies fluid under pressure through line 101 to move the piston rod 20 toward its extended position. It is to be understood that even though the datum position of the wrench is shown as being about 70° relative to the rod clamping position, the datum position could be at a greater angular offset by, for example, having the piston rod movement of the piston cylinder combination 19, 20 of an appropriate length, the dotted line position shown in FIG. 2 merely being to facilitate the description of the invention. As the piston rod 20 is extended the mounting bracket 12 is pivoted in the direction opposite arrow 110 about pivot 21. Further the pivotal position of the mounting bracket 12 when the piston rod 20 is fully extended can be adjusted by adjusting the position of the bracket 16 relative to the frame 11.

When the piston rod is in its fully extended position, the wrench 37 has been pivoted sufficiently in the direction opposite the arrow 110 to move the wrench long arm 88*a* and the jaws to a position for gripping a drill rod 36 that is axially aligned with the bore hole, the pressure builds up in the sequence valve and operates in a conventional manner to apply fluid pressure through line 104 to cause extension of the piston rod 63 (movement in the direction of arrow 112) from the position shown in FIG. 7. This results in the hook jaw actuator 59 being pivoted in the direction of arrow 111 about pivot 58 and thereby move the jaw bracket 80 a limited amount longitudinally in the direction opposite of the arrow 112 and pivot about the rounded edge of the plate 84 that abuts against the slide handle. The pivotal movement of the jaw bracket in the above manner is limited by the jaw bracket arm edges 81*a* of the arms 81 abutting against the slide handle along the major portion of the length of said edges. However if the position of hook arm 88 has been properly longitudinally adjusted by appropriate threading of the nut 89 on the hook jaw, the jaw insert 90 will abut against the drill rod 36 before edge 81*e* and the slide housing along their adjacent length portions are in abutting relationship (hooked jaw moved to its rod gripping position).

After movement of the insert 90 into abutting relationship to the drill rod, further extension of the piston rod 63 acts through rocker arm 70 and pivot 58 to force the slide housing to move longitudinally in the direction of arrow 112 against the resilient action of the return spring to move the fixed jaw 95 therewith until its jaw insert 95*b* is moved into abutting relationship with the drill rod 36 (fixed jaw rod gripping position) to clampingly hold the drill rod 36 against rotation while the drill rod (not shown) is rotated by conventional apparatus (not shown) to uncouple one rod from the other. The longitudinal length of the slide housing slot 52 is sufficiently long to permit such movement of the slide housing and its flange 35 away from the stop bolt 43. While the rotation of the rod to be uncoupled from rod 36 proceeds, the wrench 37 can move vertically due to the spacing of the bracket plates 14 and the provision of the slide bearings.

When the wrench is to be operated to its drill rod release position, the sequence valve is operated to applied fluid under pressure to the cylinder 66 for retracting the piston rod 63 to pivot the rocker in the direction opposite arrow 112 whereby the hook jaw is moved toward its release position and the slide handle to move longitudinally in the direction opposite arrow 112. The longitudinal movement of the slide housing similarly moves the fixed jaw, the return longitudinal movement of the slide housing being aided by the return spring to move the housing flange 35 into abutting relationship with the stop bolt. Now the cylinder 19 is operated through the action of the sequence valve to pivot the wrench to the datum position of the wrench.

Not previously mentioned is that it is desirable that the pivot axes of pivots 58, 62, 64 and 73 in the piston rod 63 extended and retracted positions are located relative to one another such that the jaw bracket as it is moved between jaw rod release and clamping positions, the hook jaw bracket is moved predominantly longitudinally and only a limited pivotal amount. Also the pivot 58 is located substantially more closely adjacent to pivot 73 than to pivot 62 and that hook jaw in both of its release and rod gripping positions has its terminal end portion that is opposite the short arm 88*b* located substantially more closely longitudinally adjacent to pivot 24 than any one of pivots 58, 62 and 73 and is longitudinally intermediate the slide housing side walls.

Also not previously mentioned is that the pivot axes of the pivots referred to herein are parallel to one another and to the central axis of the bore hole that the drill rod is to moved into and out of, and perpendicular to the planes of the axes of elongation of the planes of the piston cylinder combinations.

What is claimed is:

1. A clip constructed integrally of resilient metallic wire for attaching a fishing lure to a line comprising:

an arcuate line attaching loop consisting of a single bend on one end of said clip and having free ends spaced closely adjacent each other and being substantially equidistant on opposite sides of the center line of the loop in substantially the same plane;

a pair of substantially straight elongated tension bars, one tension bar extending outwardly from an abutment formed at each free end of said loop in the same plane as said loop;

said tension bars diverging outwardly away from each other generally throughout their length urging said abutments into contact when compressed;

a pair of inwardly converging bars, one of said converging bars extending inwardly from each free end of said tension bars and having a free end opposite said arcuate line attaching loop;

said inwardly converging bars having overlapping end portions remote from tension bars; and a pair of overlapping loops each carried by a respective overlapping end portion of said inwardly converging bars opposite said single bend extending in opposed relation in a plane substantially normal to said plane of said line attaching loop and tension bars, opened when said tension bars are compressed.

2. The apparatus of claim 1, further characterized in that the operable second means includes a transversely elongated rocker having an intermediate portion pivotally connected to the slide member, a first end portion and a second end portion, and fourth means for mounting the second jaw and moving the second jaw, the fourth means being pivotally connected to the rocker first end portion.

3. A clip constructed integrally of resilient material for attaching a fishing lure to a line comprising:

an arcuate line attaching loop consisting entirely of a single wire disposed in a single plane on one end of said clip and having free ends spaced closely adjacent each other;

a pair of substantially straight elongated tension bars, one tension bar extending outwardly from each of said free ends in the same plane as said loop;

said tension bars diverging outwardly away from each other generally throughout their length;

an abutment adjacent each free end of said loop from which said bars extend outwardly, engageable when said bars are compressed;

a pair of inwardly converging bars, one of said converging bars extending inwardly from each free end of said tension bars and having a free end opposite said arcuate line attaching loop;

said inwardly converging bars having overlapping end portions remote from tension bars; and a pair of overlapping loops each carried by a respective overlapping end portion of said inwardly converging bars extending in opposed relation in a plane substantially normal to the plane of said line attaching loop and tension bars opened by compressing said tension bars.

4. A clip integrally of resilient metallic wire for attaching a fishing lure to a line comprising:

an arcuate line attaching loop consisting of a single bend on one end of said clip and having free ends spaced closely adjacent each other and being substantially equidistant on opposite sides of the center line of the loop in substantially the same plane;

a pair of elongated tension bars, one tension bar extending outwardly from an abutment formed at each free end of said loop in the same plane as said loop urging said abutments into contact when compressed;

said tension bars diverging outwardly away from each other;

a pair of inwardly converging bars, one of said converging bars extending inwardly from each of said tension bars and having a free end opposite said arcuate line attaching loop;

said inwardly converging bars having overlapping end portions remote from tension bars; and a pair of overlapping loops forming together with said overlapping end portions a substantially complete circle, each loop carried by a respective overlapping end portion of said inwardly converging bars extending in opposed relation in a plane substantially normal to a plane of said line attaching loop and tension bars, opened when said tension bars are compressed.

5. A clip constructed integrally of resilient metallic wire for attaching a fishing lure to a line comprising:

a line attaching loop consisting of a single bend on end of said clip and having free ends spaced closely adjacent each other and being substantially equidistant on opposite sides of the center line of the loop in substantially the same plane;

a pair of substantially straight elongated tension bars, one tension bar extending outwardly from an abutment formed at each free end of said loop;

said tension bars diverging outwardly away from each other generally throughout their length urging said abutments into contact when compressed;

a pair of substantially straight inwardly converging bars, one of said converging bars extending inwardly from each free end of said tension bars and having a free end opposite said arcuate line attaching loop in the same plane as said loop;

said inwardly converging bars having overlapping end portions remote from said tension bars; and a pair of overlapping loops each carried by a respective overlapping end portion of said inwardly converging bars extending in opposed relation in a plane substantially normal to the plane of said line attaching loop, opening when said tension bars are compressed.

6. The apparatus of claim 5 further characterized in that the cooperating means includes a first stop device on one of the arm and the slide member, a second stop device on the other of the arm and the slide member having the first stop member thereon and being abuttable against the first stop device and that the fourth means includes a spring device for resiliently urging the slide member to move longitudinally relative to the arm to a datum position that the stop devices are in abutting relationship with one another and away from a slide member second position that the stop devices are at their maximum limited spacing.

7. The apparatus of claim 6 further characterized in that the slide member is longitudinally elongated and has a first end portion mounting one of the stop devices and a second end portion, that the second means includes rocker having an intermediate portion pivotally connected to the slide member second end portion, a first end portion and a second end portion pivotally connected to the third means for being moved thereby, and fifth means pivotally connected to the rocker first end portion for mounting the second jaw and longitudinally moving the second jaw relative to the slide member and arm as the rocker is pivoted relative to slide member.

8. The apparatus of claim 6 further characterized in that the third means includes first piston cylinder means having a cylinder and a piston rod movable relative the cylinder from a retracted position to an extendable position for moving the rocker to longitudinally move the slide member relative to the arm and the fifth means for moving the second jaw between its drill rod release and clamping positions, the cylinder being pivotally connected to one of the slide member, the mounting bracket and the rocker and the piston rod being pivotally connected to one of the other of the slide member, rocker and bracket from which the cylinder is pivotally connected to, one of the pivotal connections of the cylinder and piston rod being to the rocker.

9. The apparatus of claim 8 further characterized in that the third means includes second piston cylinder means having a second cylinder and a second piston rod extendable relative to the second cylinder for moving the mounting bracket from its datum position to its bracket clamping position, the second cylinder being pivotally connected to one of the mounting frame and the mounting bracket and the second piston rod being pivotally connected to the other of the mounting bracket and the mounting frame from which the second cylinder is connected.

10. The apparatus of claim 8 further characterized that when the mounting bracket is in its wrench clamping position, the stop devices are in abutting relationship, the jaws are in their rod release position and the piston and cylinder are in their relative retracted position, the rocker connections to the third and fifth means and the slide member are located relative to one another that as the piston rod is extended relative to the cylinder, the rocker is moved to move the fifth means to move the second jaw into abutting relationship to the drill rod and thence longitudinally move the slide member to move the first jaw to clamp the drill rod between the jaws, the wrench having means on the second jaw for cooperating with the fifth means to selectively longitudinally adjust the position the second jaw relative to the fifth means.

11. The apparatus of claim 10 further characterized in that the stop device mounted on the arm is adjustable for selectively varying one limit position of the slide member relative to the arm, that the piston cylinder means is pivotally connected to the slide member and that the fifth means includes a longitudinally elongated jaw bracket having a first end portion pivotally connected to the rocker and a second end portion having means for mounting the second jaw for limited rocking movement relative thereto, the jaw bracket second end portion being longitudinal opposite the first jaw from the rocker arm.

12. Power wrench apparatus that is operable for clampingly retaining a drill rod or the like in a stationary relationship relative thereto, comprising a wrench having a first jaw and a hook second jaw, the jaws being at least predominately longitudinally movable relative to one another between rod release and rod clamping positions that the jaws are more longitudinally closely adjacent to one another than in their release position, longitudinally elongated first means for mounting the second jaw for longitudinal movement relative to the first jaw and limited pivotal movement relative thereto, the first means having a longitudinal first end portion and a longitudinal opposite second end portion, a mounting frame, a mounting bracket, second means for mounting the mounting bracket to the mounting frame, the second means including a first pivot mounted by the mounting bracket, a jaw actuator, longitudinally elongated third means mounting the jaw actuator for movement therewith and relative thereto and being movably mounted on the first pivot for movement between a datum position that the wrench is remote from the drill rod and a rod clamping position, the third means having a first end portion pivotally mounted by the first pivot and a longitudinally elongated second end portion, the wrench first jaw being fixed to the third means second end portion to move therewith, a second pivot mounted by the third means second end portion longitudinally more remote from the first pivot than the first jaw and mounting the jaw actuator, a third pivot for pivotally connecting the jaw actuator to the first means second end portion in transverse spaced relationship to the second pivot to longitudinally move the first means as jaw actuator arm is pivoted about the second pivot, a fourth pivot mounted to the jaw actuator in transverse spaced relationship to the second and third pivots, and piston cylinder means pivotally connected between the fourth pivot and at least one of the mounting frame, the third means first end portion and the mounting bracket for first moving the third means between its datum position and its wrench clamping position and then the jaw actuator to move the first means to move the second jaw longitudinally more closely adjacent to the first jaw.

13. The apparatus of claim 12 further characterized in that the third means includes a longitudinal slide member having a first end portion more closely adjacent to the first pivot than the second pivot and an opposite second end portion having the fixed jaw mounted thereon and mounting the second pivot, and arm means for mounting the slide member for limited translatory movement relative thereto, the arm means including a longitudinally elongated arm having a first end portion mounted on the first pivot and a second end portion mounting the slide member for longitudinal movement relative thereto while blocking any significant pivotal movement relative thereto.

14. The apparatus of claim 13 further characterized in that the third means includes cooperating fourth means on the arm and the slide member for limiting the movement of the slide member in a direction toward the first pivot and cooperating fifth means on the arm and the slide member for limiting the movement of the slide member in a direction away from the first pivot and constantly resiliently urging the slide member in a direction toward the first pivot.

15. The apparatus of claim 14 further characterized in that the piston cylinder means includes a cylinder and a piston rod movable relative to the cylinder between an extended position and a retracted position, one of the cylinder and the piston rod being pivotally connected to the fourth pivot, the second, third and fourth pivots being located relative to one another that as the piston rod extends the jaw actuator moves the slide member away from the first pivot and moves the first means longitudinally relative to the slide member toward the slide member first end portion to move the jaws toward the rod clamping position.

16. The apparatus of claim 13 further characterized in that the wrench includes means on the second jaw for acting in cooperation with the first means for selectively longitudinally adjusting the spacing of the second jaw relative to the first jaw.

17. The apparatus of claim 16 further characterized in that the second means includes a pivot mounting the mounting bracket to the mounting frame for pivotally movement between a datum position and a second rod clamping position, and that the piston cylinder means includes a first piston cylinder combination connected between the mounting frame and mounting bracket for pivoting the mounting bracket between its positions, and a second piston cylinder combination pivotally connected between the slide handle and the fourth pivot for pivoting the jaw actuator about the second pivot.

18. Power wrench apparatus that is operable for clamping retaining a drill rod or the like in a stationary relationship relative thereto, comprising a mounting member, a wrench having first and second jaws that are movable relative to one another between a drill rod release position and a drill rod clamping position, each jaw having a rod engaging position, a slide member mounting the first jaw for movement therewith, arm first means for mounting the slide member for limited movement relative thereto and having a longitudinally elongated arm, the arm having a first end portion mounted to the mounting member and a longitudinally elongated second end portion mounting the slide member for limited translatory movement relative thereto and mounting the first jaw in fixed relationship thereto for movement therewith, operable jaw bracket second means mounting the wrench second jaw for movement therewith and relative thereto to move the second jaw to a rod engaging position, the jaw bracket means including a first end portion and a longitudinal opposite second end portion mounting the second jaw for movement therewith and relative thereto, a piston cylinder combination that includes a cylinder and a piston rod mounted by the cylinder for movement between an extended condition and a retracted position, one of the cylinder and the piston rod being pivotally connected to one of the slide member and the mounting bracket, and third means interconnected to the slide member second end portion, the jaw bracket second end portion and the other of the piston rod and cylinder from that which is connected to one of the slide member and the mounting bracket to longitudinal move the slide member away from the mounting member to move the fixed jaw to a rod engaging position and longitudinally moving the second jaw to its rod engaging position as the piston rod is moved from its retracted position toward its extended position, the third means including a first pivot connected to the slide member second end portion, a second pivot connected to jaw bracket means second end portion and a third pivot connected to said other of the cylinder and piston rod, the pivot connections having parallel pivot axes.

19. The apparatus of claim 18 further characterized in that the slide member and arm means includes cooperating means for limiting the movement of the slide member longitudinally toward and away from the arm first end portion, the cooperating means including resiliently means for urging the slide member in a direction toward the arm first end portion, the piston rod in moving to its extended position acting through the third means to move the slide member against the resilient means in a direction away from the first end portion and moving the first jaw toward its rod engaging position.

20. The apparatus of claim 19 further characterized in that the third means includes a jaw actuator having an intermediate portion that is pivotally connected to the slide member by the first pivot, a first end portion that is pivotally connected by the second pivot to jaw bracket means and an opposite end portion pivotally connected to the said other of the cylinder and piston rod, the jaw actuator being elongated and extending generally transversely to the slide member direction of longitudinal movement both when the jaws are in their clamping position and in their release position.

21. The apparatus of claim 19 further characterized in that the mounting member includes a mounting frame and a mounting bracket mounted on the mounting frame for movement relative thereto and that there is provided a second piston cylinder combination connected between the mounting frame and the mounting bracket for moving the bracket between an out of the way datum position and a wrench rod clamping position.

* * * * *

UNITED STATES PATENT AND TRADEMARK OFFICE

CERTIFICATE OF CORRECTION

PATENT NO. : 5,040,438

DATED : 08/20/1991

INVENTOR(S) : Joseph E. R. Rousseau

It is certified that error appears in the above-identified patent and that said Letters Patent is hereby corrected as shown below:

Column 2, line 31, change "Of" to --of--.

Change claim 1 to read

--1. Power wrench apparatus that is operable for clamping retaining a drill rod or the like in a stationary relationship relative thereto, comprising a mounting frame, a mounting bracket, a first pivot member for mounting the mounting bracket to the mounting frame for pivotal movement relative thereto about a first pivot axis between a bracket datum position and a wrench clamping position substantially angularly spaced from its datum position, a wrench having first and second jaws that are movable relative to one another between a drill rod release position and a drill rod clamping position, a slide member mounting the first jaw for movement therewith, longitudinally elongated arm first means having a first end portion mounted to the mounting bracket for movement therewith and a longitudinally elongated arm for mounting the slide member for movement therewith and limited longitudinal movement relative to the arm, operable second means mounted to the slide member for movement therewith and relative thereto for moving the second jaw relative to the first jaw between jaw release and rod clamping positions, and power operable third means connected to the second means and at least one of the frame and the bracket for first moving the bracket from its datum position to its drill rod clamping position and thence operating the second means to move the slide member longitudinally relative to the arm and the operable second means relative to the slide member to move the jaws from their release position to their rod clamping positions.--.

UNITED STATES PATENT AND TRADEMARK OFFICE

CERTIFICATE OF CORRECTION

PATENT NO. : 5,040,438

DATED : 08/20/1991

INVENTOR(S) : Joseph E. R. Rousseau

It is certified that error appears in the above-identified patent and that said Letters Patent is hereby corrected as shown below:

Change claim 3 to read

--3. The apparatus of claim 2, characterized in that the wrench includes means for coacting with second jaw and the fourth means for selectively adjusting the longitudinal position of the second jaw relative to the first jaw and the fourth means, and that the fourth means includes means for mounting the second jaw for limited rocking movement relative to the pivot connection between the rocker first end portion and the fourth means.--.

Change claim 4 to read

--4. The apparatus of claim 3, further characterized in that the third means includes piston cylinder means pivotally to the rocker second portion for moving the rocker relative to the arm.--

Change claim 5 to read

--5. The apparatus of claim 1 further characterized in that arm and slide member includes cooperating means for limiting the longitudinal movement of the slide member relative to the arm in opposite longitudinal directions and block any significant pivotal movement of the slide member relative to

UNITED STATES PATENT AND TRADEMARK OFFICE

CERTIFICATE OF CORRECTION

PATENT NO. : 5,040,438
DATED : August 20, 1991
INVENTOR(S) : Joseph E. R. Rousseau It is certified that error appears in the above-indentified patent and that said Letters Patent is hereby corrected as shown below:

the arm--.

Signed and Sealed this

Nineteenth Day of October, 1993

Bruce Lehman

*Attest:*

BRUCE LEHMAN

*Attesting Officer*

*Commissioner of Patents and Trademarks*